US005197803A

United States Patent [19]

Wall et al.

[11] Patent Number: 5,197,803

[45] Date of Patent: Mar. 30, 1993

[54] MIXER WITH MOVABLE WIPER

[76] Inventors: Joseph E. Wall, 9051 Whirlaway Ct., Alta Loma, Calif. 91701; John F. Tobin, P.O. Box D 1641, 23050 Ponderosa Dr., Crestline, Calif. 92325

[21] Appl. No.: 803,114

[22] Filed: Dec. 5, 1991

[51] Int. Cl.[5] ..... B01F 7/04

[52] U.S. Cl. ..... 366/309; 366/67; 366/149; 366/159; 366/160; 366/184; 366/308; 425/206; 425/209; 425/229

[58] Field of Search ..... 366/67, 71, 76, 96, 366/97, 98, 99, 100, 131, 134, 136, 137, 152, 159, 160, 162, 172, 173, 177, 182, 184, 254, 279, 286, 289, 302, 308, 309, 312, 349, 138, 144, 149; 422/133, 138; 425/206, 209, 228, 229, 232

[56] References Cited

U.S. PATENT DOCUMENTS

| | | | |
|---|---|---|---|
| 830,336 | 9/1906 | Lake | 366/254 |
| 989,342 | 4/1911 | Doering | 360/309 |
| 2,995,346 | 8/1961 | Samples | 422/133 |
| 3,381,941 | 5/1968 | Gibson | 366/308 |
| 3,894,722 | 7/1975 | Jones | 366/177 |
| 3,986,705 | 10/1976 | Nauta | 366/326 |
| 4,469,130 | 9/1984 | James | 366/152 |
| 4,486,102 | 12/1984 | Thiele | 366/182 |
| 4,544,277 | 10/1985 | Schnellmann | 366/289 |
| 4,548,776 | 10/1985 | Holdredge | 425/209 |
| 4,695,433 | 9/1987 | Scriuo | 366/131 |

FOREIGN PATENT DOCUMENTS

| | | | |
|---|---|---|---|
| 212895 | 2/1958 | Australia | 366/285 |
| 306599 | 3/1933 | Italy | 366/286 |
| 49102 | 5/1940 | Netherlands | 366/162 |

*Primary Examiner*—Harvey C. Hhornsby
*Assistant Examiner*—Terrence R. Till
*Attorney, Agent, or Firm*—Lyon & Lyon

[57] ABSTRACT

A mixer is mechanically self cleaned without using solvents. A housing defines a mixing chamber with a fluid pressurized mixer head rotatably supported within the housing. The mixer head has retractable mixing paddles. A wiper scrubs material from the mixing head and chamber walls as it is advanced through the mixing chamber during cleaning. A nozzle plunger drives material from a mixing chamber nozzle.

19 Claims, 5 Drawing Sheets

MIXER WITH MOVABLE WIPER

BACKGROUND OF THE INVENTION

The field of the invention is mixers. In many applications, it is necessary to mix two materials together. For example, in manufacturing urethane or epoxy products, a hardener must be mixed with a base material. Similarly, it is often necessary to mix e.g., paints and thinners or to mix other hardeners, solvents, emulsifiers, dyes, etc. with one or more other materials, in any range of proportions.

In the past, various dynamic mechanical mixers have used rotors spinning within a mixing chamber. In other applications, impingement mixers have been used to achieve mixing by spraying or injecting one stream of material into another stream of material in a turbulent flow. However, impingement mixers are limited to approximately a 1:1 ratio of materials, as well as to materials having relatively low viscosities. So called static mixers which achieve varying degrees of material mixing by flowing the materials over fixed blades, have also been used.

Generally, dynamic mechanical mixers using a spinning mechanical rotor are advantageous due to their high mixing efficiency, wide range of mixing ratios and materials that they can handle, as well as their relatively compact and simple designs and high output rates.

On the other hand, dynamic mechanical mixers typically must be flushed and cleaned with toxic solvents such as methylene chloride, trichloroethylene and others, to clean the mixing chamber and mechanical parts in between mixing batches of urethane, epoxy, etc. Unfortunately, while the materials being mixed, for example, urethane, are relatively non-toxic and non-pollutin $\underline{g}$, the cleaning solvents are highly volatile, toxic and contribute significantly to air pollution. These solvents are also very costly to purchase, handle, and dispose of. In addition, relatively large volumes of solvents are required for mixer cleaning. The used solvents are potentially very damaging to the air and ground environment.

A wide range of products such as computer cases, spas, wheels, bowling balls, gaskets, interior automobile parts, etc. are made from urethanes, isocyanates and other materials which require multiple part mixing. Consequently, the mass production manufacturing operations for these products presently use relatively large volumes of solvents to flush and clean mixing equipment. Since cleaning solvents contribute to air pollution, and because restrictions on their use is currently under consideration by government agencies such as the Southern California Air Quality Management District, there is a great need for alternative mixers or cleaning methods in many manufacturing industries.

SUMMARY OF THE INVENTION

Accordingly, it is an object of the invention to provide a mixer which may be cleaned without solvents. Other and further objects and advantages will appear hereinafter.

To these ends, a mixer includes a housing defining a mixing chamber. A mixer head is rotatably supported within the housing. The mixer head has paddles which can be extended and retracted from the mixer head. The mixer head is pressurized with a material compatible fluid to prevent the material being mixed from flowing into the mixer head. A wiper plate within the mixing chamber has an outside surface matching the contour of the mixing chamber walls and an inside bore generally matching the outside diameter of the mixer head.

The mixer head has a chamfered end which is configured to match a seat at the end of the mixing chamber. To clean the mixer, the mixing head is forcibly engaged against the seat to squeeze out any remaining material on the seat. The wiper is driven through the mixing chamber and scrubs any material remaining in the chamber from the chamber walls and the mixer head. The remaining material is mechanically driven or squeegeed out of the mixing chamber into the output nozzle of the mixing chamber. A nozzle plunger is advanced into the nozzle to mechanically eject the material from the nozzle.

The mixer housing is attached to a cylinder body. A drive shaft extends within the cylinder body and mixer housing. The mixing head is attached to a geared or splined section of a drive shaft within the mixing chamber. The geared drive shaft engages a toothed rack on each of the paddles in the mixing head. A primary piston within the cylinder body is connected to the wiper. A secondary piston within the cylinder body is attached to the nozzle plunger. The cylinder body has four hydraulic ports for driving the primary and secondary-cylinders in either direction, to press the mixer head against the seat, advance and retract the wiper, and to advance and retract the nozzle plunger.

A hydraulic motor turns the drive shaft. The paddles on the mixer head are extended by braking the mixer head (by driving a ring bushing forward under fluid pressure) while turning the drive shaft at the same time. Since there is no direct mechanical connection between the drive shaft and the mixing head, except through the paddles, the paddles remain extended or retracted until the mixing head is braked or held in position while the drive shaft is turned.

BRIEF DESCRIPTION OF THE DRAWINGS

In the drawings, wherein similar reference characters denote similar elements throughout the several views.

DETAILED DESCRIPTION OF THE DRAWINGS

Figure 1:
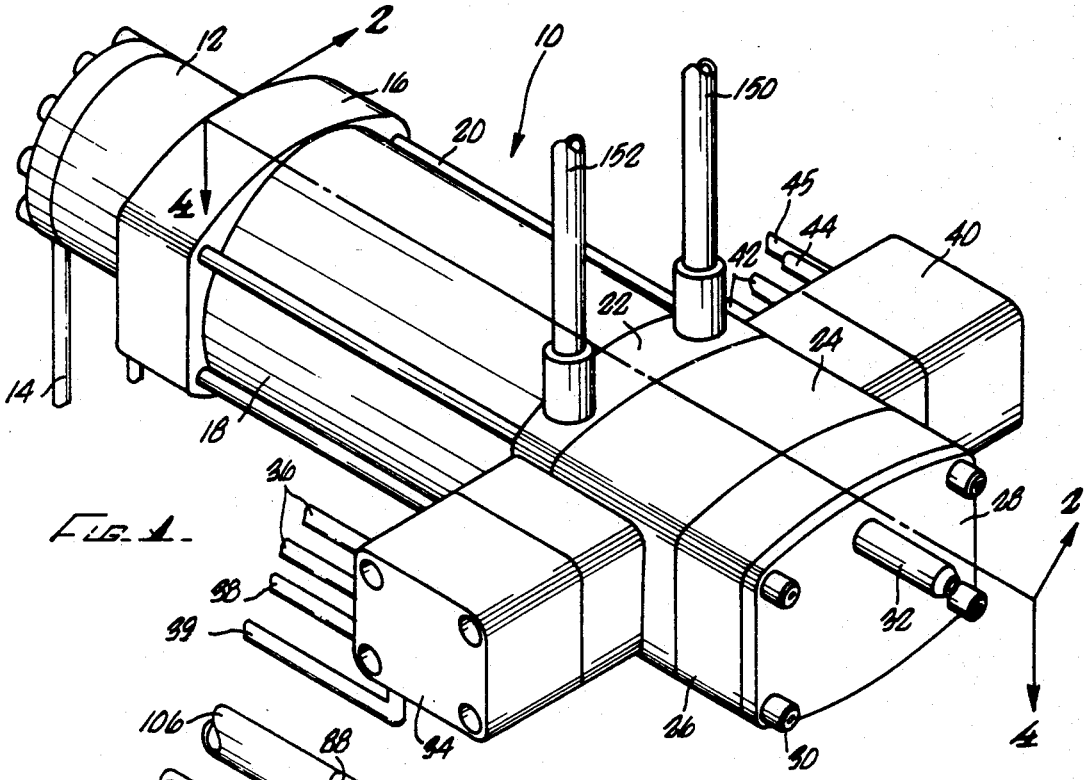
FIG. 1 is a perspective view of the present mixer.

Turning now in detail to the drawings, as show in FIG. 1, a mixer 10 has a hydraulic mixer motor 12 attached to a cylinder end cap 16 of a cylinder body 18. Hydraulic lines 14 run from a hydraulic source (not shown) to drive the hydraulic mixer motor 12. A center section 22 is clamped to the cylinder body 18 by four tie bolts 20 which pass through clearance holes in the cylinder end cap 16 and thread into the center section 22. A housing 24 is attached to the center section 22 and a retainer cap 28 and bearing plate 26 are secured to the housing 24 by cap screws 30. An output nozzle 32 extending from the retainer cap 28 has a nozzle bore leading to a mixing chamber 118 within the housing 24. The embodiment of the mixer 10 shown in FIG. 1 is designed for mixing two materials together, such as a urethane and a hardener. However, other embodiments suitable for mixing two or more materials would be obvious to those skilled in the art, without departing from the scope of the invention.

An A side input valve 34 and a B side input valve 40 are attached on opposite sides of the housing 24. Valve control lines 36 hydraulically open and close valve 34. Similarly, valve control lines 42 open and close the B side input valve 40. Supply lines 38 and 44 deliver to the valves 34 and 40 the A and B materials which will be mixed together. Return lines 39 and 45 are also provided on the A and B sides. When the material pumps for the A and/or B materials (not shown) are running, and the valves 34 and 40 are closed, the material flows into the valves through the supply lines 38 and 44 and recirculates out of the valves and back to the pump through the return lines 39 and 45. In this recirculate mode, either valve 34 or 40 can be open or closed to either recirculate or dispense material. Recirculate mode can help to set the proper mix ratio.

Figures 2, 2A, 2B:
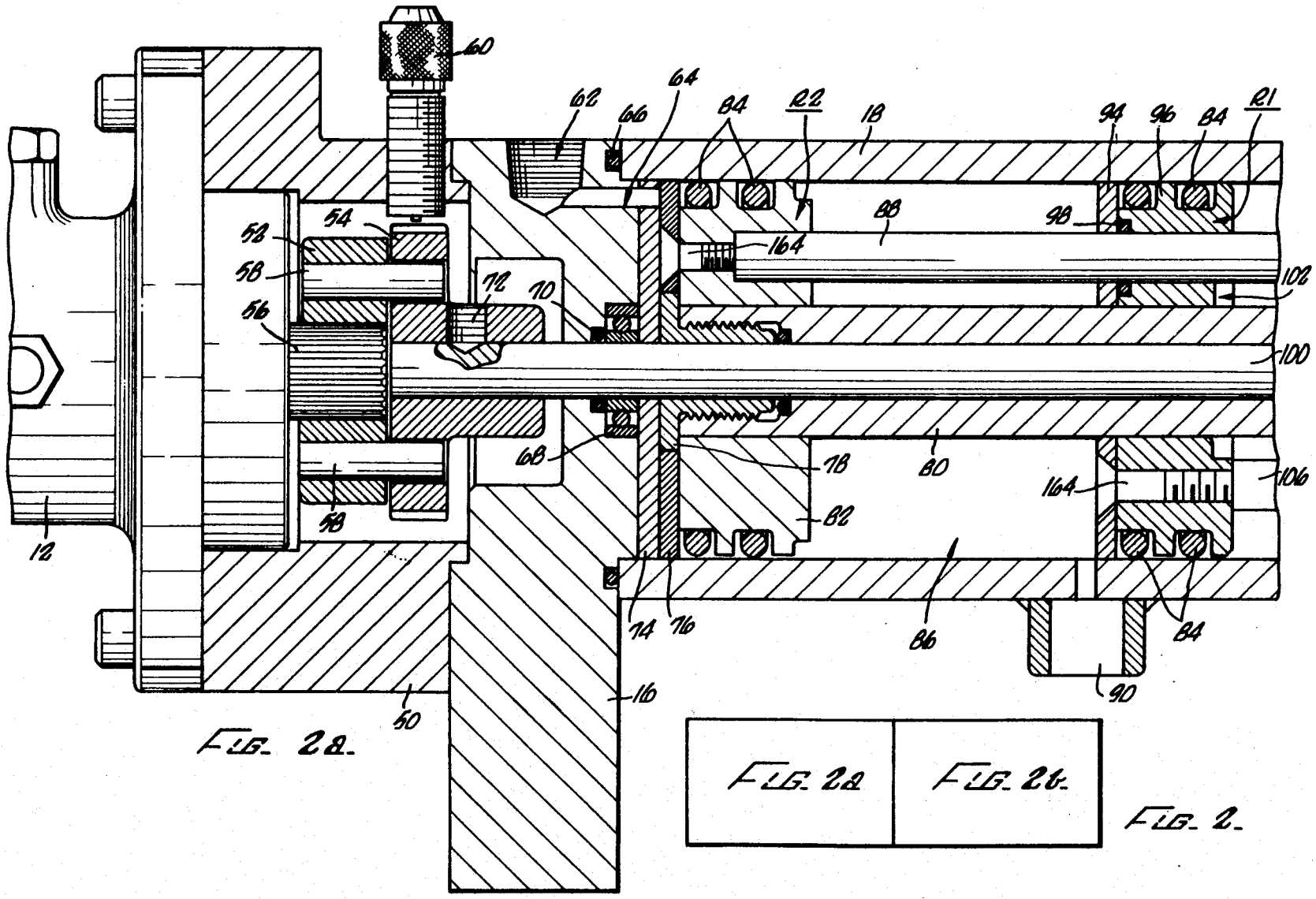
FIG. 2 (2A and 2B) is a enlarged section view taken along line 2—2 of FIG. 1.

Turning to FIG. 2 and specifically to FIG. 2A, a motor adapter 50 joins the hydraulic mixer motor 12 to the cylinder end cap 16. An O-ring 66 seals the cylinder end cap 16 to the cylinder 18. A drive coupler 52 around the output shaft 56 of the motor 12 is linked to a gear drive 54 through shear pins 58. The drive gear 54 is secured to a drive shaft 100 by a set screw 72. A tachometer sensor 60 detects the speed of the drive shaft 100.

Within the cylinder body 18 is a primary piston 96 and a secondary piston 82, both slidably mounted on a primary piston limiter 80. The secondary piston 82 has O-rings 84 to allow the secondary piston 82 to slide within the cylinder body 18 while maintaining a seal against it. A retainer limiter 78 is screwed into the primary piston limiter 80. A secondary piston retainer plate 76 surrounds the retainer limiter 78 at the back of the secondary piston 82. An end cap retainer plate 74 around the drive shaft 100 separates the retainer limiter 78 and the secondary piston retainer plate 76 from a first drive shaft bearing 68 secured in the cylinder end cap 16. An O-ring 70 provides a seal between the cylinder end cap 16 and the drive shaft 100.

Figures 2B, 3:
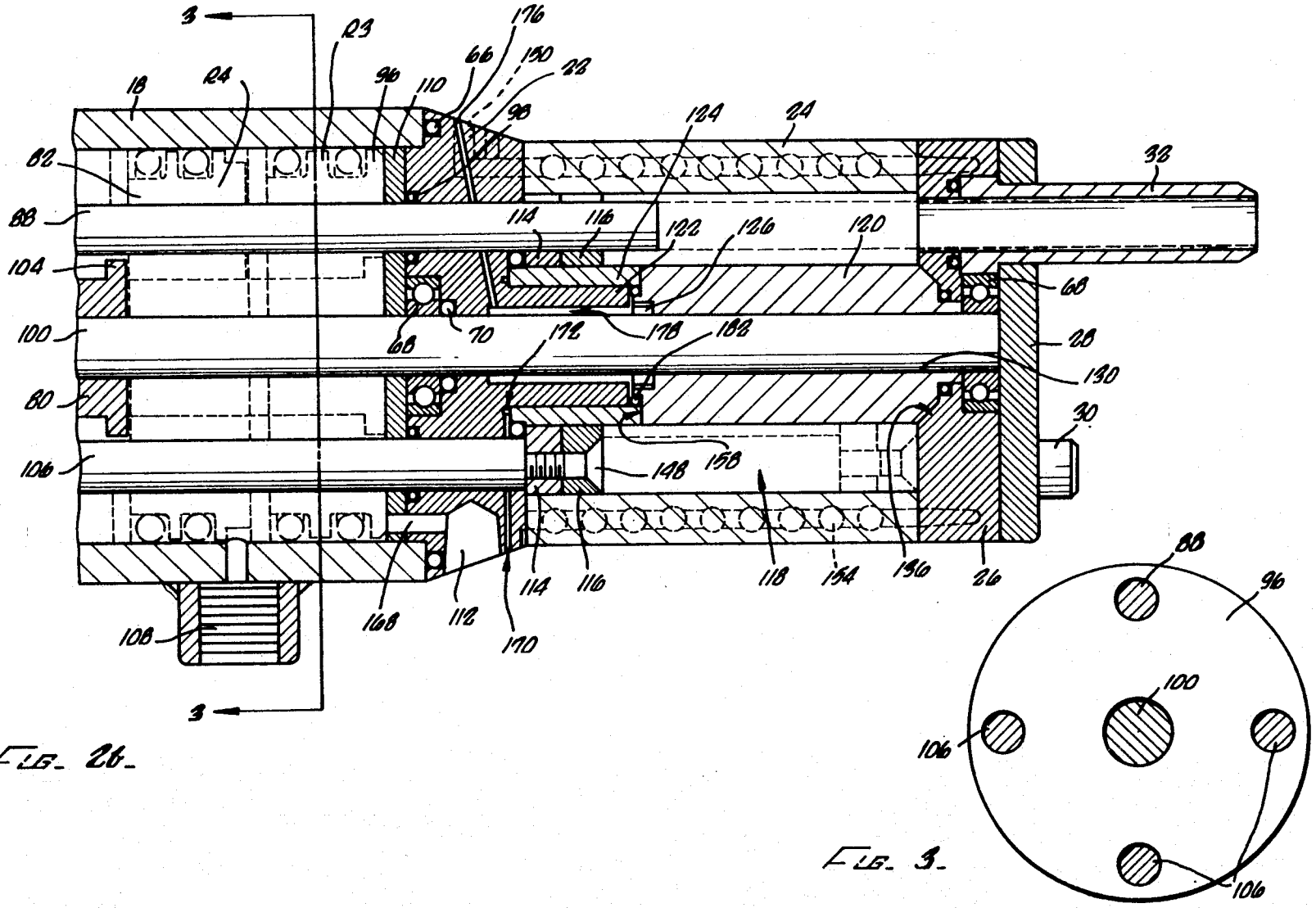
FIG. 3 is a partial section view taken along line 3—3 of FIG. 2B.

The primary piston 96 also has two O-rings 84 for slidably sealing the primary piston 96 against the inner walls of the cylinder body 18. A primary piston retainer plate 94 is secured against the back end of the primary piston 96. A nozzle plunger 88 is attached to the secondary piston 82 by a flat head screw 164. The nozzle plunger 88 passes through the primary piston retainer plate 94 and primary piston 96 and is sealed against the primary piston 96 by an O-ring 98. Three actuation rods 106 are attached to the front surface of the primary piston 96 by screws 164, as shown in FIGS. 2A and 3. A first hydraulic port 62 in the cylinder end cap 16 extends into the cylindrical space within the cylinder body 18 through a bore 64. The secondary piston 82 and primary piston 96 shown in FIG. 2A, at positions R2 and R1, are in the "mixing" position and are separately driven forward for cleaning operations, as described below. A second hydraulic port 90 similarly extends into the cylinder body 18 at a position in between the R1 and R2 piston positions, as shown in FIG. 2A.

Turning to FIG. 2B, the primary piston limiter 80 has a flange ring 104 dimensioned to seat within a recess ring pocket 102 in the front face of the primary piston 96, as shown in FIG. 2A. The three actuation rods 106 extend through holes in the center section 22 and are attached to a wiper plate 116 and a plunger backing plate 114 by screws 148. The wiper plate 116 is preferably made of Nylon. A center section retainer plate 110 is secured against the center section 22 and backs a second drive shaft bearing 68. O-rings 98 seal the nozzle plunger 88 and actuation rods 106 as they pass through the center section 22. O-ring 70 provides a seal between the center section 22 and the drive shaft 100. A third hydraulic port 108 leads through the cylinder body 18 at the position shown in FIG. **2*b*, i.e., in between the pistons 96 and 82 when they are fully advanced forward to the R3 and R4 positions as shown. A fourth hydraulic port 112 extends into the center section 22 and through a bore 168 into the very front of the cylinder chamber 86. A center section sleeve 122 extends forward of the center section 22 around the drive shaft 100. A ring bushing 124 is axially slidably but irrotatably mounted on the center section sleeve 122**.

The center section 22 also has a mixing head braking port 170 leading to an annular braking channel 172 behind the ring bushing 124. Pressurizing the braking channel 172 drives the ring bushing 124 forward slightly to brake the mixing head 120. A mixing head pressurization port 176 extends through the center section 22 to a shaft channel 178 within the center section sleeve 122. An o-ring 182 seals the shaft channel so that the mixing head 120 can be positively fluid pressurized through the pressurization port 176, to prevent in flow of material into the mixing head 120.

Within the housing 24 is the mixing chamber 118. A mixing head 120 is supported on the drive shaft 100 within the center of the mixing chamber 118. A head retainer 126 maintains the mixing head 120 in position on the drive shaft 100. The back surface of the mixing head 120 has a flat head pressure surface 158. The housing 24 has a cooling jacket 154 linked to a chilled water inlet and outlet 150.

Figure 5:
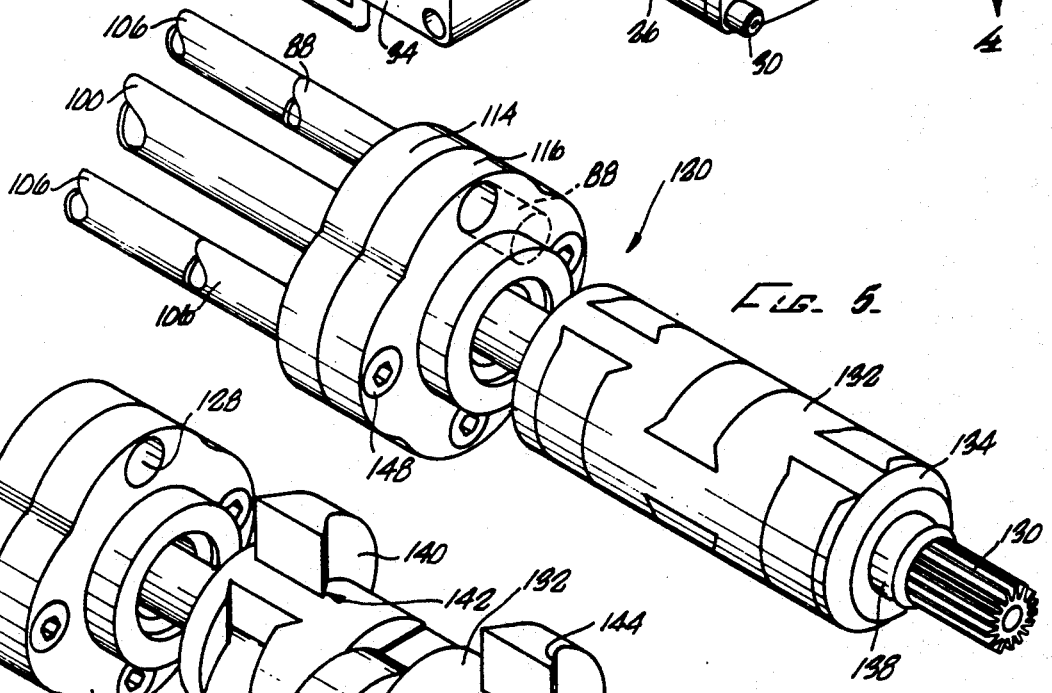
FIG. 5 is an enlarged perspective view of the mixer head with the paddles retracted.

As shown in FIG. 3, the three actuation rods 106 extend through the center section 22 and support the plunger backing plate 114 and wiper plate 116. The nozzle plunger 88 is also aligned with and can extend through a hole in the center section 22, the backing plate 114 and the wiper plate 116 (FIG. 5). The drive shaft 100 rotatably extends through the center section 22, the plunger backing plate 114 and wiper plate 116 and through the mixing head 120.

Figure 4:
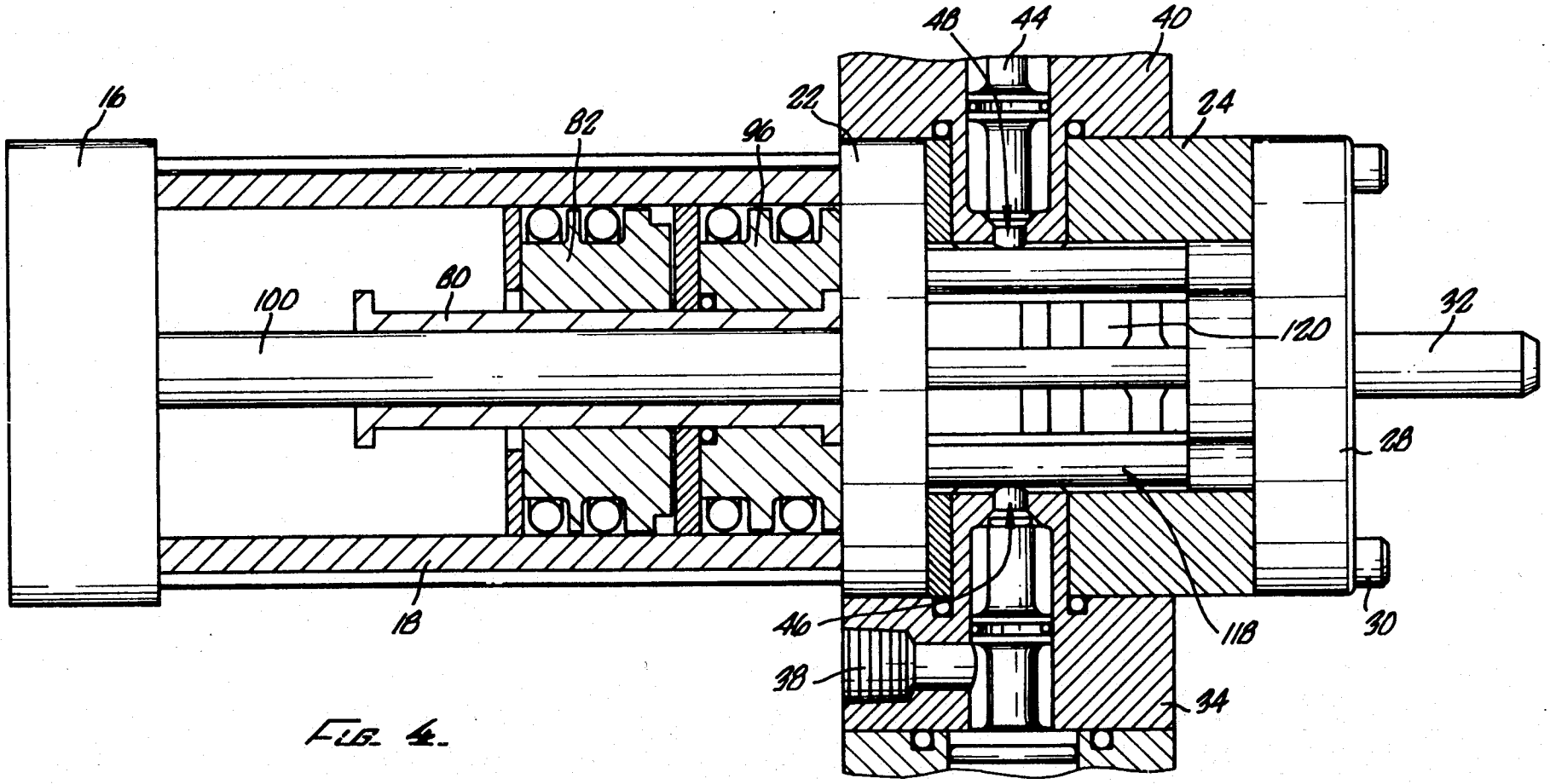
FIG. 4 is a section view fragment generally taken along the line 4—4 of FIG. 1.

Turning to FIG. 4, a mixing chamber supply port 46 for the A side connects the supply line 38 through the valve 34 to the mixing chamber 118. Similarly, a mixing chamber supply port 48 for the B side leads from the input valve 40 to the mixing chamber 118. Of course, additional supply ports could be provided for 3 or more part mixing.

As shown in FIGS. 5–8, the mixing head 120 includes a head barrel 132 having a plurality, preferably 6, dove tail slots 142 and a chamfer 134 at the forward end. The chamfer 134 is shaped to match the seat 136 in the bearing plate 26. A bearing sleeve 138 extends forward of the chamfer 134 to engage a third drive shaft bearing 68 held in the bearing plate 26. A plurality of mixing paddles 140 are extendably mounted on or in the head barrel 132. Each mixing paddle 140 has a dove tail front surface 144 slidably positioned within a dove tail slot 142 in the head barrel 132.

Figure 6:
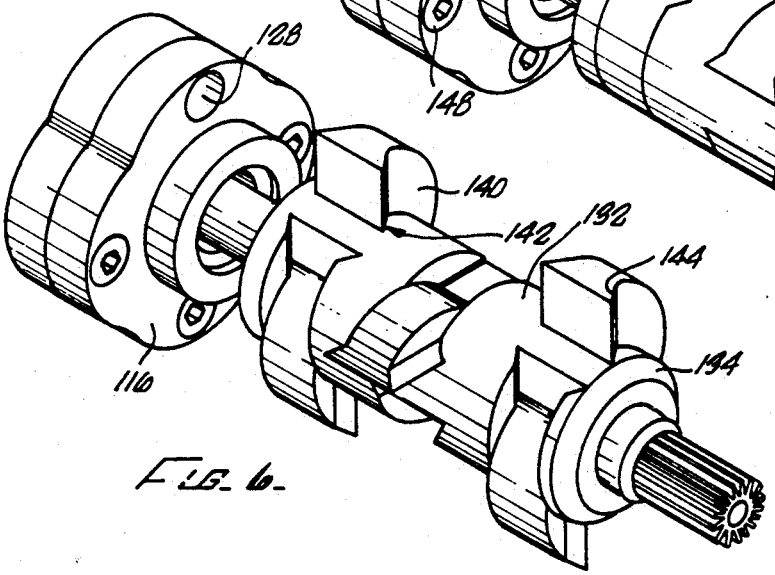
FIG. 6 is an enlarged perspective view of the mixer head with the paddles extended.
Figure 7:
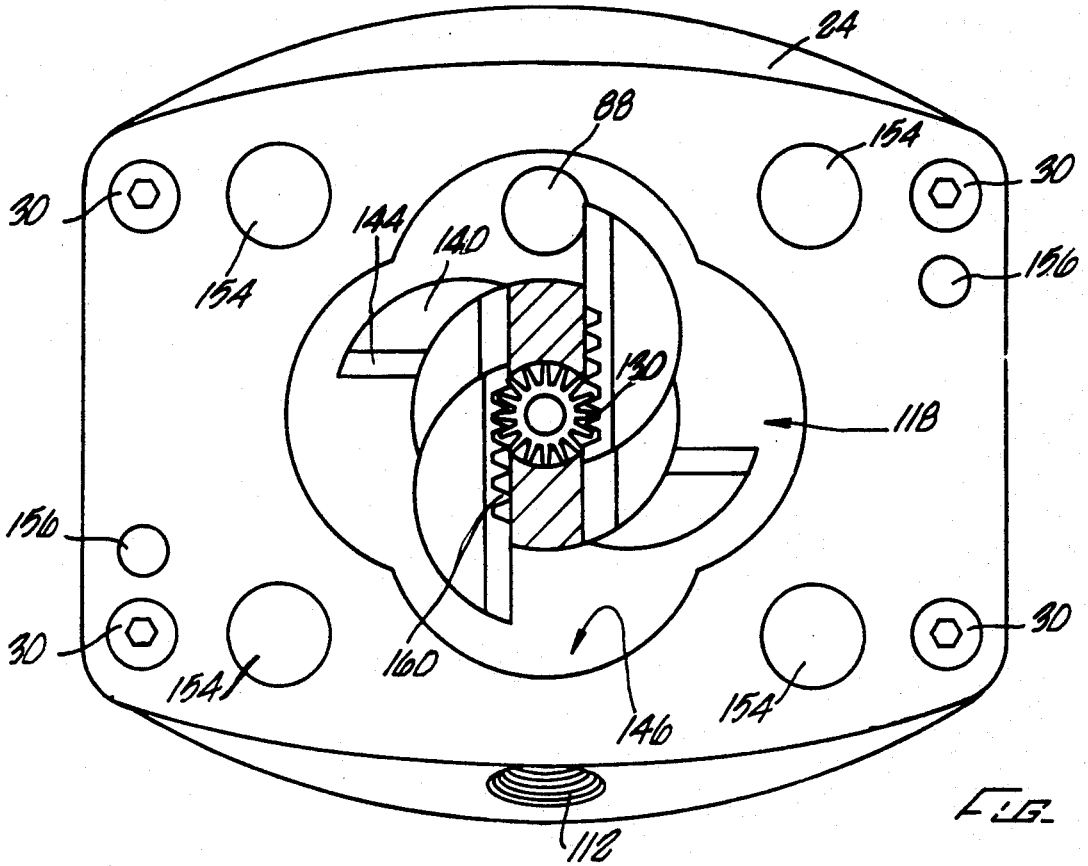
FIG. 7 is an end view of the mixer with the retainer cap and bearing plate removed to illustrate the mixing chamber and showing the paddles extended from the mixing head.

As shown in FIG. 7, the front surface of each mixing paddle 140 has a set of rack teeth 160 along the inner section of the mixing paddle 140. The drive shaft 100 has a geared section 130 with parallel longitudinally extending teeth. The front of the drive shaft 100 engages the third drive shaft support bearing 68 in the bearing plate 26. (For illustration purposes only, the geared end 130 is shown substantially extended from the head barrel 132 in FIGS. 5 and 6, although the end 130 actually extends beyond the head barrel 112 only sufficiently to engage the bearing 68 as shown in FIG. 2B.) The rack teeth 160 on the mixing paddles 140 engage the geared section 130 of the drive shaft 160. The head barrel 132 is not directly engaged by or attached to the geared section 130 of the drive shaft 100.

As shown in FIGS. 5, 6 and 7, if the head barrel 132 is braked or held in position while the drive shaft 100 is turned counterclockwise, the mixing paddles 140 will be extended from the head barrel 132, by the engagement and interaction of the splined section 130 and the rack teeth 160. Similarly, if the head barrel 132 is held stationary and the drive shaft 100 is turned clockwise, the paddles will be retracted so that they become flush with the outer circumference 162 of the head barrel 132.

Figure 8:
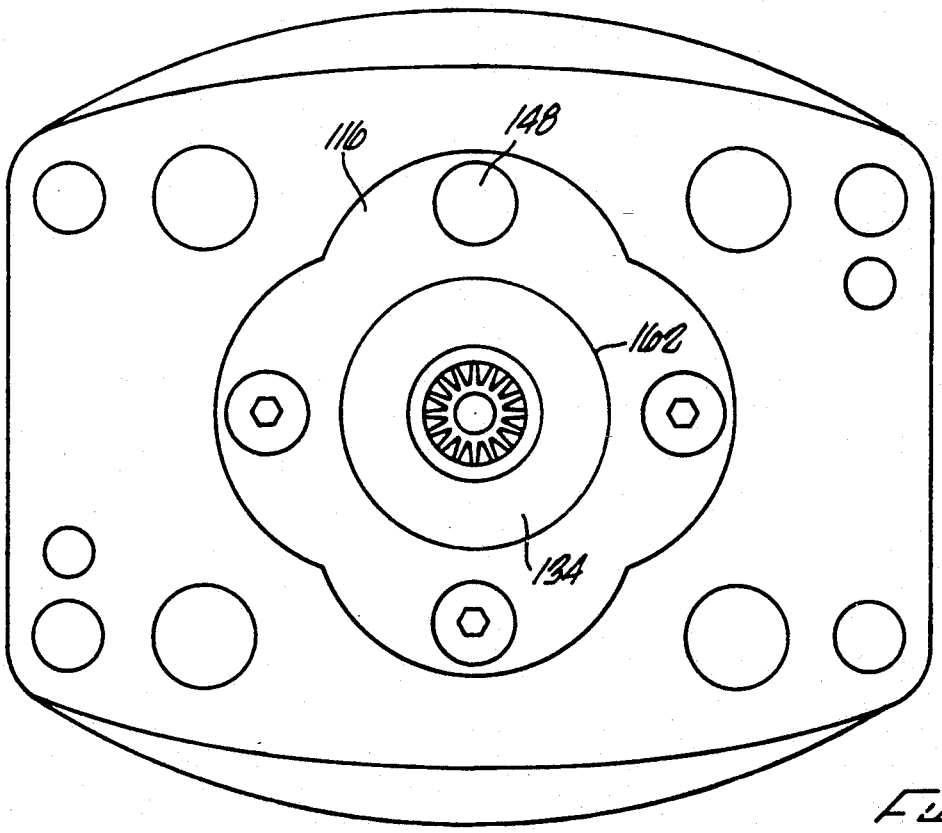
FIG. 8 is a similar end view thereof showing the paddles retracted.

As shown in FIGS. 7 and 8, the mixing chamber 118 has chamber lobes 146. Dowel pin holes 156 are provided in the end face of the housing 24 for positioning and mounting of the bearing plate 26 and retainer cap 28.

In operation, the material to be mixed flows from the supply lines 38 and 44 into the mixing chamber 118 and is metered (i.e., on or off) by the valves 34 and 40. The secondary piston 82 is in the retracted position R2, and the primary piston 96 is in position R1, as shown in FIG. 2A. R2 and R1 are the piston positions for mixing operations.

If the paddles are in the retracted flush position, as shown in FIG. 5, they are extended by braking or holding the head barrel 132 in position as the drive shaft 100 is turned. This is achieved by introducing hydraulic fluid pressure into the mixing head braking port 170 to urge the ring bushing 124 forward, thus clamping and braking the head barrel 132 between the ring bushing 124 and the seat 136.

With the head barrel 132 held in position, the motor 12 is driven counterclockwise through an acute angle causing the drive shaft 100 to turn and extend the mixing paddles 140, to the positions shown in FIG. 6. The hydraulic pressure is released from the mixing head braking port 170 allowing the ring bushing 124 to back off. This frees up the head barrel 132. The hydraulic motor 12 is driven counterclockwise at a mixing speed which in turn drives the drive shaft 100 and the mixing paddles 140 engaged to the geared section 130 of the drive shaft 100. The torque transmitted from the drive shaft 100 to the mixing paddles 140 is in turn exerted on the head barrel 132 such that the entire mixing head 120 spins within the mixing chamber 118. The movement of the mixing paddles 140 thoroughly mixes the two materials A and B which flow through the mixing chamber 118 and out through the output nozzle 32. The pressure of the supply lines 38 and 44 maintains the flow through the mixing chamber 118. Chilled water may optionally be circulated through the cooling jacket 154 to maintain the housing 24 at a desired temperature, e.g., a temperature which allows sufficient time for the mixed material to flow out of the mixer 10 to a mold, etc., before setting. Stale material can stay in the mixer between shots. It is sometimes desirable to leave mixed material in the mixer between shots. Cleaning or purging is needed only when material is ready to harden. Cleaning can therefore be selective.

While the materials are being mixed in the mixing chamber 118, they are under pressure. Accordingly, ordinarily, the materials could flow through the clearance spaces between the mixing paddles 140 and the head barrel 132. This would allow the material to enter the center bore of the head barrel 132 and migrate forward into the front bearing 68. To keep the materials from flowing into the mixing head 120 and hardening in the rack teeth 160 or front bearing 68, a fluid such as di octyle pthalate (DOP) fluid or similar chemical is introduced under pressure into the center of the head barrel 132 through the mixing head pressurization port 176 and the shaft channel 178. The DOP or other pressurized fluid counteracts the positive pressure in the mixing chamber 118. Some of the DOP or pressurizing fluid will escape into the mixing chamber through the clearances in the mixing head components, and be mixed with the materials in the mixing chamber 118. The pressurizing fluid is therefore selected to be non reactive with the materials being mixed. For example, with urethane, DOP is preferably used since it is urethane compatible and has a minimum effect on the final product. For the same reason, DOP is used as the hydraulic or driving fluid for the motor 12, primary and second pistons 92 and 86, as well a for the valves 34 and 40. Any leak of driving fluid from these components would therefore not degrade a final urethane product. In contrast, ordinary hydraulic oil is not compatible with urethane and any hydraulic oil leaks within the mixer reaching the mixing chamber 118 would be unacceptable.

After a batch of material has been mixed, any material remaining in the mixing chamber 118 must be removed to prevent it from hardening and binding up in the mixer, or to prepare the mixer for mixing a new and/or different batch of materials. This cleaning process is achieved, without using solvents, by first applying hydraulic pressure through the second port 90 and opening the fourth port 112. This drives the primary piston 96 forward from position R1 to R2. As this occurs, the inner surface of the wiper plate 116 slides longitudinally forward over the head barrel 132 and the outer surface of the wiper plate slides against the walls of the mixing chamber 118. This scrubs or squeegees any material remaining on the mixing head 120 and chamber walls forward to the front end of the mixing chamber 118.

While pressure is maintained on the second port 90, hydraulic pressure is also introduced to the first port 62. This drives the secondary piston forward causing the primary piston limiter 80 and the nozzle plunger 88 to advance. The head barrel 132 is driven forward against the seat 136 by pressurizing the mixing head braking port 170, thereby squeezing any material out of the seat area. The nozzle plunger 88 advances and pushes material out of the nozzle 32. The primary and secondary pistons, when fully extended forward, occupy the positions R3 and R4, as shown in FIG. 2B.

The pistons are then retracted by releasing pressure to the first port 62 and pressurizing the fourth port 112.

This drives the primary piston 96 back to the R1 position. While maintaining pressure on the fourth port 112, hydraulic pressure is supplied to the second port 90 which causes the secondary piston 82 to slide back to the R2 position shown in FIG. 2. The mixer 10 is then ready for the next mixer operation.

In an alternative mixer cleaning sequence, second port 90 is pressurized enough to bring the wiper plate 116 far enough forward so that it begins to slide over the head barrel 132 but does not reach the rear most paddles, (i.e., an alternate R2 position). The sliding friction between the wiper plate 116 and head barrel 132 provide sufficient braking for paddle extension/retraction. The hydraulic motor 12 is reversed (to turn clockwise) and the paddles 140 are retracted providing the mixing head 120 with a smooth outer perimeter, as shown in FIG. 5. Then, with the fourth port 112 remaining open, the first port 62 is pressurized with the second port 90 remaining pressurized. The primary piston 96 is driven forward until the wiper plate 116 moves entirely over the mixing head 120 and contacts the bearing plate 26. The third port 108 is open to allow the secondary piston 82 to come forward to the R4 position.

The operation of the motor 12, valves 34 and 40, and application of hydraulic pressure to the various ports can be controlled by a suitably programmed microprocessor. The tachometer sensor provides a feedback input for controlling mixing speed and detecting a stall condition. The motor, valves and pistons are preferably hydraulically operated since any leaks of hydraulic fluid into the materials being mixed (e.g. urethanes) is not significantly detrimental to the final product.

Thus, a mixer is disclosed which is cleaned without using solvents. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A mixer comprising:

a housing substantially defining a mixing chamber having inner chamber walls;

a mixer head rotatably supported within the housing, the mixer head having at least one mixing protrusion;

means for extending and retracting the at least one protrusion from the mixer head;

a wiper positioned within the housing the wiper having an outer wiper surface slidably engageable to the inner chamber walls, and having an inner wiper surface slidably engageable over the mixer head when said at least one protrusion is in a retracted position; and means for longitudinally moving the wiper through the mixing chamber in between the mixer head and the housing.

2. The mixer of claim 1 further comprising:

a nozzle attached to the housing and having a nozzle bore;

a nozzle plunger slidably positioned within the housing and aligned with the nozzle bore; and means for moving the nozzle plunger into and out of the nozzle bore.

3. The mixer of claim 1 wherein the at least one protrusion comprises at least one paddle.

4. The mixer of claim 3 further comprising a drive shaft having a geared section with parallel longitudinally extending teeth extending into the mixer head and engaging a rack on the at least one paddle whereby relative rotation between the shaft and mixer head causes the paddle to extend from and retract into the mixer head.

5. The mixer of claim 4 wherein the means for extending and retracting comprises a motor attached to the drive shaft, the motor operable in both clockwise and counterclockwise directions, and braking means engageable to the mixer head for braking the mixer head.

6. The mixer of claim 5 wherein the braking means comprises a bushing displaceable against the mixer head by fluid pressure, to urge and hold the mixer head against the housing.

7. The mixer of claim 5 wherein the motor comprises a fluid driven motor and the braking means comprises a fluid driven bushing for clamping the mixer head against the housing.

8. The mixer of claim 1 further comprising pressure introducing means connecting to the mixer head for introducing a pressurizing fluid into a space between the protrusion and the mixer head.

9. The mixer of claim 1 further comprising a mixer head seat on the housing having a seat contour, and a chamber on the mixer head substantially matching the seat contour.

10. The mixer of claim 1 wherein the mixing chamber has a front end and a back end, and wherein the means for moving the wiper moves the wiper longitudinally from the back end to the front end to push any remaining admixture to the front end of the mixing chamber.

11. The mixer of claim 1 wherein the mixing chamber has four lobes.

12. The mixer of claim 1 wherein the at least one protrusion is generally semi-circular and has a dove-tail base.

13. A mixer comprising:

a cylinder body;

a mixer housing attached to the cylinder body;

a drive shaft extending within the cylinder body and mixer housing;

a mixing head within the mixer housing supported on the drive shaft;

at least one paddle linked to the drive shaft and extendible and retractable from the mixing head when said at least one paddle is in a retracted position;

a wiper slidably displaceable longitudinally through the mixer housing to wipe the mixer head and inside walls of the mixer housing;

a primary piston within the cylinder body connected to the wiper; and means for longitudinally driving the primary piston within the cylinder body.

14. The mixer of claim 13 further comprising valves for controlling fluid flow into and out of the cylinder body.

15. The mixer of claim 14, wherein the means for driving the primary piston comprises a fluid pump connected through the valves to spaces in the cylinder body on opposite sides of the primary piston.

16. The mixer of claim 13 wherein the mixer head is longitudinally displaceable on the shaft.

17. A mixer for mixing materials comprising:

a cylinder body;

a mixer housing attached to the cylinder body;

a drive shaft extending within the cylinder body and mixer housing;

a mixing head within the mixer housing supported on the drive shaft;

at least one paddle linked to the drive shaft and extendible and retractable from the mixing head;

a wiper slidably displaceable over the mixing head when said at least one paddle is in a retracted position and through the mixer housing;

a primary piston within the cylinder body connected to the wiper;

means for driving the primary piston within the cylinder body;

an output nozzle joined to the mixer housing;

a nozzle plunger to push material through said nozzle extending within the cylinder body and aligned with the output nozzle;

a secondary piston within the cylinder body attached to the nozzle plunger; and means for driving the secondary piston within the cylinder body.

18. The mixer of claim 17 further comprising a primary piston limiter slidably mounted around the drive shaft and slidably passing through the primary piston and the secondary piston.

19. A mixing apparatus for urethanes cleanable without solvents comprising:

a housing;

mixing chamber walls within the housing substantially forming a mixing chamber;

a shaft supported by the housing and extending into the mixing chamber;

a cylindrical mixer head, supported in the mixing chamber on the shaft;

a plurality of paddles attached to the mixer head and extendible and retractable from a closed position wherein the paddles are generally flush with the mixer head, to an open position wherein they protrude from the mixer head;

means for moving the paddles to and from the open and closed positions;

a wiper having an outer surface for wiping against the mixing chamber walls and an inner surface for wiping against the mixer head when said paddles are in a closed position; and a wiper driver attached to the wiper for pushing the wiper longitudinally within the mixing chamber, such that any material remaining the mixing chamber is scraped off of the mixing chamber walls and mixer head, to clean the mixer without solvents.

* * * * *